US006344108B1

(12) United States Patent
Von Medvey et al.

(10) Patent No.: US 6,344,108 B1
(45) Date of Patent: Feb. 5, 2002

(54) USING A DICARBOXYLIC ACID DIALKYL ESTER BRIGHTENING

(75) Inventors: Ingo Von Medvey, Duisburg; Thomas Rajcsanyi, Dinslaken; Peter Hänssle, Haltern; Joachim Werres, Drebber, all of (DE)

(73) Assignee: Stockhausen GmbH & Co. KG, Krefeld (DE)

( * ) Notice: Subject to any disclaimer, the term of this patent is extended or adjusted under 35 U.S.C. 154(b) by 0 days.

(21) Appl. No.: 09/355,333

(22) Filed: Aug. 30, 1999

(30) Foreign Application Priority Data

Feb. 4, 1997 (DE) ..... 197 04 054

(51) Int. Cl.[7] ..... D21B 1/14; D21B 1/16; D21C 9/10

(52) U.S. Cl. ..... 162/25; 162/72; 162/76; 162/91

(58) Field of Search ..... 162/72, 76, 164.3, 162/4, 5, 6, 8, DIG. 4, 25, 71, 91

(56) References Cited

U.S. PATENT DOCUMENTS

| | | | | |
|---|---|---|---|---|
| 4,013,505 A | * | 3/1977 | Balcar et al. | 162/8 |
| 5,127,993 A | | 7/1992 | Chen | 428/342 |
| 5,298,120 A | | 3/1994 | Blackstone | 162/76 |
| 5,316,623 A | * | 5/1994 | Espy | 162/164.3 |
| 5,609,722 A | * | 3/1997 | Rodriguez et al. | 162/5 |
| 5,705,383 A | * | 1/1998 | Blanchette et al. | 162/72 |

FOREIGN PATENT DOCUMENTS

| | | |
|---|---|---|
| DE | 2 52 322 | 5/1911 |
| DE | 41 03 572 | 8/1992 |
| DE | 195 09 401 | 11/1995 |
| DE | 195 15 272 | 10/1996 |
| EP | 0 553 649 | 8/1993 |
| EP | 0 639 434 | 2/1995 |
| EP | 0 717 143 | 6/1996 |
| WO | WO 94/12721 | 6/1994 |
| WO | WO 94/12722 | 6/1994 |
| WO | WO 94/29510 | 12/1994 |
| WO | WO 95/00704 | 1/1995 |
| WO | WO 96/18770 | 6/1996 |

OTHER PUBLICATIONS

Roempp Chemielexikon, 9th ed., pps. 3208 & 4345, 1991.
H.U. Suess, et al., Wochenblatt fuer Papierfabrikation, vol. 9, pps. 320–325, "Hochgebleichter CTMP–Ein Zellstoffersatz?", 1986.
Patents Abstracts of Japan, vol. 014, No. 053 (C–683), Jan. 31, 1990, JP 1 280088, Nov. 10, 1989.
Patents Abstracts of Japan, vol. 014, No. 242 (C–721), May 23, 1990, JP 2 61190, Mar. 1, 1990.
Patents Abstracts of Japan, vol. 018, No. 040 (C–1155), Jan. 21, 1994, JP 5 263379, Oct. 12, 1993.
Patents Abstracts of Japan, vol. 018, No. 040 (C–1155), Jan. 21, 1994, JP 5 263380, Oct. 12, 1993.

* cited by examiner

*Primary Examiner*—Steve Alvo
(74) *Attorney, Agent, or Firm*—Oblon, Spivak, McClelland, Maier & Neustadt, P.C.

(57) ABSTRACT

A process for producing fibrous materials for the manufacture of cellulose, paper or wood materials by using at least one dicarboxylic acid dialkyl ester and/or a copolymer of polyester-polyether and/or fatty acid polyol monopolyester, dipolyester, tripolyester and or higher polyester. Fibrous materials with an improved quality and higher yield are thus produced.

16 Claims, No Drawings

USING A DICARBOXYLIC ACID DIALKYL ESTER BRIGHTENING

The invention relates to a process for producing fibrous materials for the manufacture of cellulose, paper, or boards of wood material, using at least one dicarboxylic acid dialkyl ester and/or a fatty acid polyol mono-, di-, tri-, and/or higher polyester and/or polyester-polyether copolymer, and to the products produced from these fibrous materials, such as cellulose, paper and wood material boards.

Fibrous materials or fiber raw materials such as mechanical wood materials and long-fibered raw materials and, in particular, thermomechanical pulp (TMP) or chemithermomechanical pulp (CTMP) are obtained in mechanical wood pulping by defiberizing reduced wood materials with separation and fibrillation of single fibers according to a thermal or chemical-thermal pretreatment (cf., Römpp Chemielexikon, 9th edition, 1991, pages 3208 and 4345).

Owing to its superior fiber length and brightness, TMP is better suited in replacing cellulose than groundwood pulp and therefore, also with respect to cost, is used in manufacturing bulk printing papers, such as rotary printing paper, light-weight paper, and cardboard articles. In the production of semichemical pulps, and in cellulose recovery as well, one attempts to decrease the substance content of lignin and hemicellulose by delignification and/or oxidative or reductive bleaching processes in order to reduce yellowing in articles produced using these materials. These efforts in bleaching wood materials have been reported in detail by H. U. Süss and W. Eul in Wochenblatt für die Papierfabrikation 9 (1986), pp. 320–325, where it has been determined that yellowing of the materials may occur which depends on the dosage of the bleaching chemicals, affecting the whiteness stabilization of the products. As a variant of the well-known Alcell or Organocell processes, DE 41 03 572 C2 performs the delignification of plant fibrous materials, particularly wood chips, in such a way that initially, the chips are completely impregnated with alcohol in order to avoid a fiber-damaging effect of the subsequent addition of alkali.

WO 94/12721 and WO 94/12722 describe delignification processes using peracetic acid and complex compounds with subsequent bleaching using ozone or sodium dithionite, while DE 195 09 401 A1 subjects wood pulps and secondary semichemical fibrous pulps to a multistage peroxide bleaching under pressure, wherein the complexing agents used are said to improve the effect of the perhydroxy anions on lignin chromophores present in the interior of the fibers.

According to EP 553,649 B1, the delignification of cellulose pulp is performed using a mixture of monopersulfuric acid and sulfuric acid with subsequent neutralization.

As the use of chemicals in the production of CTMP gives rise to waste water problems, the process for manufacturing wood fiber boards according to EP 639,434 B1 omits the removal of the chemicals after pulping.

The bleaching of lignin-containing materials with oxidants, using hydroxylamine and hydroxamic acid compounds, or a large number of compounds including an N-hydroxy, oxy, N-oxy, or N,N'-dioxy function is described in EP 717,143 A1, wherein esters of 1-hydroxybenzotriazole, cinnamic acid and 4-tert-butylbenzoic acid are mentioned as components in the process.

According to WO 95/00704, components of degradation products of native starch are also added to the wood pulp suspension in order to fix resins, which components, however, readily undergo microbiological degradation in the stock circulation, unless countermeasures are provided.

Similarly, products produced by alkoxylation of $C_{10}$–$C_{22}$ carboxylic acid derivatives and/or $C_{10}$–$C_{22}$ carboxylic acids having OH groups, e.g., those produced from soybean oil or linseed oil, are to be added according to DE 195 15 272 A1 in order to control the settling of resins. The intention in this process probably is to have improved dispersion of the resins in cellulose and/or wood pulp suspensions or primary fiber suspensions in order to avoid trouble during primary fiber processing. There are no indications as to the effectiveness of these compounds.

For the treatment of lignin-containing materials, WO 94/29510 and WO 96/18770 describe multicomponent systems comprised of oxidants and oxidation catalysts, as well as mediators from the group of hydroxylamines, hydroxamic acids, aliphatic, cycloaliphatic, heterocyclic, or aromatic compounds having N-hydroxy, oxime, N-oxy, or N,N'-dioxy functions, and co-mediators containing aromatic alcohols, carbonyl compounds, aliphatic ethers, phenol ethers, and/or olefins.

Accordingly, the well-known processes for manufacturing wood pulps are characterized by the use of a large number of various adjuvants having complex effects, the use which, depending on the manufacturing conditions and the raw materials employed, must be subjected to extensive control, and they are limited in their effectiveness. It was therefore the object to find a process for producing fibrous materials that could be performed without the above-mentioned drawbacks, and wherein fibrous materials having equivalent or improved properties could be obtained.

Also, there was the problem of finding agents for use in the production of fibrous materials that would permit the production of improved fibrous materials, particularly TMP and CTMP, and the production of improved or more inexpensive products on the basis of these raw materials, and in particular, accounting for ecological aspects, such as restrictive use of chemicals polluting the environment, or utilization of low-quality raw materials or waste raw materials.

According to the invention, said object is accomplished by using one or more dicarboxylic acid dialkyl esters and/or one or more fatty acid polyol mono-, di-, tri-, and/or higher polyesters and/or polyester-polyether copolymers in the impregnating pretreatment of reduced wood raw materials.

Accordingly, the invention is directed to a process for producing fibrous materials, preferably mechanical wood pulps such as thermomechanical pulp (TMP) or chemithermomechanical pulp (CTMP) and groundwood pulp, characterized in that at least one dicarboxylic acid dialkyl ester and/or one or more fatty acid polyol mono-, di-, tri-, and/or higher polyesters and/or polyester-polyether copolymers are added during the production process, particularly during the pretreatment for impregnating the reduced wood raw material, or during reduction of the wood raw material.

The invention is directed to an agent for producing fibrous materials, preferably TMP, CTMP and groundwood pulp, characterized by containing one or more dicarboxylic acid dialkyl esters and/or one or more fatty acid polyol mono-, di-, tri-, and/or higher polyesters and/or polyester-polyether copolymers.

Surprisingly, it has been determined that dicarboxylic acid dialkyl esters and/or fatty acid polyol mono-, di-, tri-, and/or higher polyesters and/or polyester-polyether copolymers are effective in the pretreatment of reduced wood and/or plant materials, and that primary fibers produced using same are purified to a higher level from adherent lignin, resin components and other wood constituents, so that materials having improved optical properties are obtained in highest yields. According to the invention, brightness, whiteness, color tone and color saturation of the mechanical wood pulps are improved in particular, without impairing the other properties, particularly the stability properties of the fibrous materials.

According to the invention, dicarboxylic acid dialkyl and/or diisoalkyl esters of $C_2$–$C_{12}$ dicarboxylic acids with $C_1$–$C_{13}$ n- and/or isoalkanols, such as di-n-butyl oxalate, din-butyl malonate, di-n-butyl succinate, di-n-butyl glutarate, di-n-butyl adipate, di-n-butyl suberate, di-n-butyl sebacate, dimethyl adipate, diethyl adipate, di-n-propyl adipate, diisopropyl adipate, diisobutyl adipate, di-tert-butyl adipate, diisoamyl adipate, di-n-hexyl adipate, di(2-ethylbutyl) adipate, di(2-ethylhexyl) adipate, diisodecyl adipate, dimethyl phthalate, diethyl phthalate, di-n-butyl phthalate, diisobutyl phthalate, di(2-ethylhexyl) phthalate, and diisodecyl phthalate, as well as diesters of the $C_9$ dicarboxylic acid (trimethyladipic acid), and dodecanedicarboxylic acid are used as dicarboxylic acid dialkyl esters.

Likewise, esters of saturated and/or unsaturated $C_8$–$C_{18}$ fatty acids with multivalent alkanols having from 2 to 6 carbon atoms, such as glycol, trimethylolpropane, glycerol, sorbitol, and sorbitan esters of the above-mentioned fatty acids, e.g., glycerol mono- and/or glycerol di- and/or glycerol trifatty acid esters, sorbitol mono- and difatty acid esters, and sorbitan mono- and/or sorbitan difatty acid esters, and/or sorbitan trifatty acid esters are used according to the invention.

Surprisingly, so-called dirt-solving agents previously used in cleaning or in soil release agent finishings of synthetic fibers, particularly polyester-polyether copolymers such as polyethylene terephthalate and/or polyoxyethylene terephthalate copolymers were found to be agents which can be used according to the invention.

Preferably, esters of adipic acid or esters of sorbitan and more preferably, the adipic acid esters of $C_1$–$C_6$ n- and/or isoalkanols, such as dimethyl adipate, diethyl adipate, di-n-isopropyl adipate, and diisopropyl adipate, di-n-butyl adipate, and/or diisobutyl adipate, as well as the mixed esters of the above-mentioned dicarboxylic acids and alkanols, glycerol trioleate and sorbitan monooleate are used according to the invention.

The above-mentioned esters are used directly as substance or in dissolved or dispersed liquid form in amounts of 0.001–5.00 wt. %, preferably 0.01–2.0 wt. %, and more preferably 0.01–1.0 wt. %, relative to the amounts of wood and/or plants. The esters are used directly or as a dilute or concentrated aqueous or non-aqueous solution, or in the form of aqueous dispersions. Suitable solvents are n- and isoalkanols, liquid hydrocarbons and acetone. The esters may be employed alone or in combination with water-soluble or waterinsoluble solvents, dispersed to form emulsions, where nonionogenic, ionic and amphoteric, particularly non-ionic and anionic surfactants are used as emulsifiers.

For example, suitable non-ionic emulsifiers are oxyalkyl ethers, preferably oxyethylates and/or terminally blocked oxyethylates of fatty alcohols and fatty acids, or oils. Alkyl- and/or arylsulfonates, α-olefinsulfonates, α-sulfofatty acid esters, sulfosuccinic acid esters, as well as alkyl sulfates and ether sulfates, as well as carboxymethylated oxyethylates and soaps are suitable as anionic emulsifiers. The preparation of the preferably stable emulsions to be used according to the invention is well-known. For example, the hydrophobic phase containing the ester component is added to the aqueous phase containing the emulsifier and dispersed with stirring or pump-circulating.

The aforementioned dicarboxylic acid dialkyl esters and/or fatty acid polyol mono- and/or polyester and/or polyester-polyether copolymers according to the invention may be used together with other components, namely, liquid derivatives of vegetable or animal oils or fats, such as rape oil methyl ester, colza oil methyl ester, palm oil methyl ester, soybean oil methyl ester, and tallow fatty acid methyl ester, and synthetic ester oils. The above-mentioned esters are preferably added in the form of aqueous concentrated or dilute dispersions prepared optionally with addition of nonionogenic, anionic or cationic surfactants alone or in combination with water-soluble or water-insoluble solvents in a well-known manner.

The agents to be used according to the invention may also be employed in pulping raw materials on the basis of other suitable plant materials, e.g., cereal straw, or in pulping long-fibered raw materials from reed, stems, parts of oil palms and/or other $C_4$ plants, particularly when defiberizing in a refiner or boiler, from which materials wood fiber boards are produced, for example.

The process of the invention is suitable for producing fibrous materials, particularly for producing TMP, CTMP, and groundwood pulp, and in addition, in the production of refiner wood pulp (refiner mechanical pulp), and refiner wood pulp produced by chemical pretreatment (chemical refiner mechanical pulp).

Reduced woods, particularly wood chips from deciduous or coniferous trees in fresh or stored condition are preferably used as starting materials in the process according to the invention. Wood chips from sawmill wastes or other wastes or from broken wood are also suitable. The above-mentioned raw materials may also be processed together with other fibrous materials, e.g. waste paper materials, according to the process of the invention.

The production of mechanical wood pulps with high yield is performed under well-known processing conditions, the wood chips being fed into the impregnator after presteaming and thorough uniform moistening. Therein, in a fashion according to the invention, for example, at least one dicarboxylic acid dialkyl ester and/or one or more fatty acid polyol mono-, di-, tri-, and/or higher polyesters and/or polyethylene terephthalate and/or polyoxyethylene terephthalate copolymers are added separately or together with water and optionally another impregnating fluid. The wood chips are uniformly impregnated under compression and following preheating to 110–180° C., preferably 140–170° C., for 1–60 min, preferably 15–30 min, or for a short period of 1–10 min, preferably 1–5 min, fed into the first refiner stage wherein, again under pressure, the separation into single fibers and defiberizing/fibrillation is performed between the milling disks under preset load-bearing conditions. After passing the milling zone and steam separation, the refiner pulp is optionally passed into a refiner secondary milling in a 2nd refiner stage. Conventionally, an additional treatment with chemicals, e.g., latency elimination, as well as wood pulp bleaching may be performed in this stage or separately, e.g., in a steam-heated material dissolver.

The agents to be used according to the invention may be added anywhere before the actual mechanical, defiberizing disintegration of the wood pulp or plant material, e.g., separately or together with the water introduced in the grinding zone during groundwood pulp production.

Owing to the dicarboxylic acid dialkyl esters and/or one or more fatty acid polyol mono-, di-, tri-, and/or higher polyesters and/or polyester-polyether, preferably polyethylene terephthalate and/or polyoxyethylene terephthalate copolymers added according to the invention, a wood pulp having enhanced brightness and whiteness is obtained after the 1st refiner stage. The mechanical wood pulp may be subjected to additional bleaching, wherein brightness and whiteness with unchanged opacity, as well as the strength of the fibers, particularly the values of breaking length, tensile energy and breaking load are completely or approximately retained. When using the above-mentioned esters in accordance with the invention, the lignin content of the material is decreased by about 1 wt. %. When using the agents together with vegetable oil derivatives such as rape oil methyl ester in accordance with the invention, an increased wood extract value is determined.

The process of the invention may also be carried out in such a way that additional bleaching is omitted, with previously achieved brightness values and whiteness levels being retained, or in such a way that bleaching is performed with significant economy as to the amount of chemicals. In particular, subsequent yellowing of the fibrous materials can be avoided in this way by adding alkalies. Furthermore, the dicarboxylic acid dialkyl esters and/or one or more fatty acid polyol mono-, di-, tri-, and/or higher polyesters and/or polyethylene phthalate and/or polyoxyethylene terephthalate copolymers to be used according to the invention can be used as agents in the chemical treatment of wood chips, from which celluloses, or boards of wood material, or precursor products thereof can be produced according to well-known procedures.

The following examples provide a supplementary demonstration of the invention.

EXAMPLES 1–3

The production of TMP was performed in a plant for producing high-yield fibrous materials, which plant has the following characteristics:

| | |
|---|---|
| Flow rates | 40–65 kg o.d./h (oven-dry) |
| Preheater volume | 110 $dm^3$ (11 $m^3$) |
| Impregnator volume | 15 $dm^3$ (1.5 $m^3$) |
| 1st refiner stage: | |
| -Drive power | 160 kw |
| -Rotational speed | 1800–3600 rpm |
| Milling equipment diameter | 300 mm |
| 2nd refiner stage: | |
| -Drive power | 160 kw |
| -Rotational speed | 1485 rpm |

The tests were carried out at a refiner rotational speed of 3000 rpm and 143° C. and a pressure of 0.35 bars wherein, in order maintain comparability of the material properties, the specific energy input during addition of the agents was adjusted to a zero level by varying the milling gap, whereas power, rotational speed, as well as temperature and pressure values and flow rate remained constant.

40 kg of presorted wood chips at a time, having a moisture content of at least 30 wt. % relative to oven-dry wood material, were deaerated in the wood chip funnel by presteaming, uniformly moistured and, following a residence time of 15 min, fed into the impregnator via conveying screws, whereby the wood chips were squeezed under compression and adjusted to uniform impregnation with continuous metering of the impregnating fluid from a reservoir container. Di-n-butyl adipate, glycerol trioleate and glycerol trioleate in combination with rape oil methyl ester at a quantity ratio of 1:1 were used as impregnating agent and employed in the state of an aqueous emulsion consisting of 14 wt. % of the agent and 8 wt. % of a non-ionogenic emulsifier based on an ethoxylated fatty alcohol or a highly ethoxyethylated vegetable oil. The amount employed at a time was 2.8 g/kg wood chips which were immediately subjected to further treatment for about 20 min at temperatures between 110 and 160° C. and subsequently fed into a type CD 300 1st refiner stage via 2 conveying screws. After leaving the milling zone, the refiner material having formed was blown into a cyclone where separation of steam and fibrous material was effected. At a material density of 10 wt. %, a portion of the TMP amount produced was subjected to bleaching (bag bleaching) using 1.8% waterglass, 0.5% complexing agent, 1.8% NaOH, and 3.8% $H_2O_2$ (the weight percentages relate to the amount of wood material employed at a time). The bleached material was washed and acidified to a pH value ranging from 8.0 to 8.5 using $SO_2$.

The optical properties were assessed by sheet formation according to Rapid-Köbthen. To this end, 500 g of TMP (about 20 wt. % dry substance), for example, was agitated in 10 liters of tap water in a pulper. The material initial weight per sheet was 375 g.

Table 1 includes the production data and the data of the TMP produced, wherein the abbreviations represent:

| | |
|---|---|
| $W_{spec}$: | Specific energy input |
| Mill: | Milling level |
| DT: | Dehydration time |
| TP2: | Indication of average fiber liquor (starting from 3 mm corresponding to 100%) |
| R: | Splinter content |

TABLE 1

| | Impregnating agent |
|---|---|
| Comparative 1 | None |
| Example 1 | Di-n-butyl adipate |
| Example 2 | Glycerol trioleate |
| Example 3 | Glycerol trioleate and rape oil methyl ester (1:1) |

| | Power kW | Flow Rate kg o.d./h | Gap mm | $W_{spec}$ kWh/t | Mill SR | DT s | TP2 % | R 0.15 % |
|---|---|---|---|---|---|---|---|---|
| Comparative 1 | 65 | 51 | 0.20 | 1280 | 23 | — | 31.5 | 9.1 |
| Example 1 | 65 | 54 | 0.17 | 1210 | 24 | 19.4 | 31.4 | 11.2 |
| Example 2 | 65 | 52 | 0.18 | 1250 | 22 | 16.1 | 28.7 | 10.4 |
| Example 3 | 65 | 52 | 0.18 | 1250 | 25 | 25.0 | 30.2 | 22.6 |

Table 2 includes the data of the optical properties of nonbleached and bleached TMP.

TABLE 2

| | Brightness % | Whiteness | Color tone | Saturation | Opacity % |
|---|---|---|---|---|---|
| | | Nonbleached | | | |
| Comparative 1 | 61.2 | 46.6 | 2.13 | 1.58 | 92.0 |
| Example 1 | 64.2 | 48.6 | 2.10 | 1.61 | 90.7 |
| Example 2 | 64.0 | 48.0 | 2.09 | 1.66 | 90.0 |
| Example 3 | 64.7 | 49.1 | 2.08 | 1.61 | 91.3 |
| | | Bleached | | | |
| Comparative 1 | 68.1 | 50.2 | 1.94 | 1.75 | 86.4 |
| Example 1 | 71.2 | 53.9 | 1.82 | 1.63 | 86.9 |
| Example 2 | 72.3 | 54.6 | 1.79 | 1.65 | 86.1 |
| Example 3 | 72.2 | 55.3 | 1.80 | 1.58 | 87.4 |

data of the examples demonstrate that brightness and whiteness rise by 3–4 points when using the agents acording to the invention. The increase over the comparative sample, as well as the opacity are retained when additional bleaching of the TMP is performed.

Additional samples of TMP were produced according to the specified procedure, using:

| | | | |
|---|---|---|---|
| in Example | 4 Di-n-butyl adipate | amount | 5.6 kg/t |
| | 5 Di-n-butyl adipate and rape oil methyl ester (1:1) | | 5.6 kg/t |
| | 6 Glycerol trioleate | | 5.6 kg/t |
| | 7 Sorbitan monooleate | | 5.6 kg/t |
| | 8 Polyester/polyether copolymer (Dirt-solving PES-ET 1/30, Hüls AG) | | 5.6 kg/t |
| | 9 Glycerol trioleate | | 2.8 kg/t |
| | 10 Glycerol trioleate | | 1.4 kg/t |

Again, the TMP values were assessed according to sheet formation in the above-described manner. The data are summarized in Table 3.

TABLE 3

| Example | Comp. 2 | 4 40 g/kg | 5 | 6 40 g/kg | 7 40 g/kg | 8 40 g/kg | 9 20 g/kg | 10 10 g/kg |
|---|---|---|---|---|---|---|---|---|
| Whiteness (457 nm) + UV | 39.9 | 45.1 | 46.4 | 46.0 | 46.5 | 44.3 | 45.8 | 46.0 |
| Reflectance (%) Brightness | 53.7 | 59.5 | 61.3 | 60.7 | 61.0 | 58.7 | 59.8 | 60.1 |
| Colortone C./2° yellow | 2.23 | 2.09 | 2.04 | 2.06 | 2.05 | 2.09 | 2.09 | 2.10 |
| Saturation C./2° | 1.70 | 1.61 | 1.61 | 1.61 | 1.57 | 1.63 | 1.56 | 1.56 |

In addition, test samples of each TMP obtained according to Examples 4–10 were subjected to bleaching as described above. Thereafter, 300 g of the material having about 20% d.s. was diluted to 10% d.s. (dry substance) with tap water, and stirred for 30 s with a mixing bar for sheet formation. The data are summarized in Table 4.

TABLE 4

| Example | | Comp. 2 | 4 40 g/kg | 5 | 6 40 g/kg | 7 40 g/kg | 8 40 g/kg | 9 20 g/kg | 10 10 g/kg |
|---|---|---|---|---|---|---|---|---|---|
| Whiteness level | Immediat. | 39.7 | 46.6 | 46.1 | 46.9 | 46.3 | 44.3 | 46.2 | 46.8 |
| | 24 h/80° C. | 40.3 | 44.8 | 44.7 | 45.2 | 44.6 | 43.5 | 45.1 | 44.3 |
| | 3.5 h/60° C. | 48.6 | 53.9 | 55.0 | 54.7 | 54.9 | 52.7 | 54.8 | 53.4 |
| Reflectance = Brightness | Immediat. | 54.7 | 62.1 | 61.6 | 62.3 | 61.6 | 59.4 | 61.3 | 61.4 |
| | 24 h/80° C. | 56.9 | 61.5 | 61.5 | 62.0 | 61.3 | 60.0 | 61.5 | 60.4 |
| | 3.5 h/60° C. | 66.6 | 71.9 | 73.1 | 72.4 | 72.9 | 70.3 | 72.3 | 70.8 |
| Color tone C./2° | Immediat. | 2.10 | 1.99 | 2.01 | 2.00 | 2.01 | 2.04 | 2.02 | 2.05 |
| | 24 h/80° C. | 2.19 | 2.11 | 2.09 | 2.07 | 2.09 | 2.13 | 2.10 | 2.12 |
| | 3.5 h/60° C. | 1.95 | 1.86 | 1.81 | 1.83 | 1.85 | 1.89 | 1.81 | 1.90 |
| Saturation C./2° | Immediat. | 1.83 | 1.66 | 1.68 | 1.65 | 1.65 | 1.70 | 1.64 | 1.58 |
| | 24 h/80° C. | 1.92 | 1.80 | 1.82 | 1.80 | 1.81 | 1.82 | 1.77 | 1.77 |
| | 3.5 h/60° C. | 1.80 | 1.68 | 1.66 | 1.64 | 1.66 | 1.68 | 1.63 | 1.64 |

the values in tables 3 and 4 demonstrate that marked improvement in whiteness level, brightness, color tone, and saturation is achieved.

What is claimed is:

1. A process for producing wood pulp, comprising:

impregnating wood chips with a brightening agent comprising a dicarboxylic acid dialkyl ester, in an amount effective to increase brightness of said wood pulp; followed by mechanical defiberizing of the wood chips to produce a brightened wood pulp.

2. The process of claim 1, wherein the wood chips are impregnated with said brightening agents in a total amount of 0.005–5.0 wt %.

3. The process of claim 1, wherein the wood chips are impregnated with said brightening agents in a total amount of 0.01–2.0 wt %.

4. The process of claim 1, wherein the wood chips are impregnated with said brightening agents in a total amount of 0.01–1.0 wt %.

5. The process of claim 1, wherein the wood pulp is a mechanical, chemithermomechanical, or ground wood pulp.

6. The process of claim 1, wherein said wood chips comprise long-fibered raw material from $C_4$ plants.

7. The process of claim 6, wherein said $C_4$ plants are oil palms.

8. The process of claim 1, wherein said dicarboxylic acid dialkyl esters are n-alkyl or isoalkyl esters of adipic acid.

9. The process of claim 1, wherein said brightening agent further comprises esters of saturated and/or unsaturated $C_8$–$C_{18}$ fatty acids with multivalent alkanols having 2 to 6 carbon atoms selected from the group consisting of glycol, trimethylolpropane, glycerol, sorbitan, and sorbitol.

10. The process of claim 1, wherein the brightening agent further comprises polyethylene terephthalate-polyoxyethylene terephthalate- or polyoxyethylene terephtlalate-copolymers.

11. The process of claim 1, wherein the brightening agent is employed in the form of an aqueous emulsion.

12. The process of claim 1, wherein said brightening agent is used together with one or more compounds obtained from vegetable or animal oils in an amount of 0.001–5.0 wt. %, relative to the employed amount of wood chips.

13. The process of claim 1, wherein said brightening agent is used together with one or more compounds obtained from vegetable or animal oils, in an amount of 0.01–2.0 wt. %, relative to the employed amount of wood chips.

14. The process of claim 13, wherein said compound obtained from vegetable or animal oils is rape oil methyl ester, palm oil methyl ester, soybean oil methyl ester, colza oil methyl ester, tallow fatty acid methyl ester, and/or synthetic ester oils.

15. The process of claim 1, wherein said brightening agent is used together with one or more compounds obtained from vegetable or animal oils, in an amount of 0.01–1.0 wt. %, relative to the employed amount of wood chips.

16. The process of claim 1, wherein a bleaching operation is performed subsequent to the impregnating.

* * * * *

UNITED STATES PATENT AND TRADEMARK OFFICE

CERTIFICATE OF CORRECTION

PATENT NO. : 6,344,108 B1
DATED : February 5, 2002
INVENTOR(S) : Von Medvey et al.

It is certified that error appears in the above-identified patent and that said Letters Patent is hereby corrected as shown below:

Title page, Item [54] and Column 1, line 1,
The title should read:
-- [54] PROCESS FOR PRODUCING PULP USING A DICARBOXYLIC ACID DIALKYL ESTER BRIGHTENING --

Signed and Sealed this

Seventeenth Day of September, 2002

*Attest:*

*Attesting Officer*

JAMES E. ROGAN
*Director of the United States Patent and Trademark Office*